US012414590B2

(12) United States Patent
King

(10) Patent No.: US 12,414,590 B2
(45) Date of Patent: Sep. 16, 2025

(54) ADJUSTABLE TURTLENECK

(71) Applicant: Fallon & Ava LLC, Albany, NY (US)

(72) Inventor: Fallon King, New York, NY (US)

(73) Assignee: Fallon & Ava LLC, Albany, NY (US)

( * ) Notice: Subject to any disclaimer, the term of this patent is extended or adjusted under 35 U.S.C. 154(b) by 0 days.

(21) Appl. No.: 18/230,396

(22) Filed: Aug. 4, 2023

(65) Prior Publication Data

US 2024/0081431 A1 Mar. 14, 2024

Related U.S. Application Data

(60) Provisional application No. 63/404,697, filed on Sep. 8, 2022.

(51) Int. Cl.
*A41B 3/02* (2006.01)

(52) U.S. Cl.
CPC ..... *A41B 3/02* (2013.01)

(58) Field of Classification Search
CPC ..... A41D 1/04
USPC ..... 2/131
See application file for complete search history.

(56) References Cited

U.S. PATENT DOCUMENTS

D112,320 S * 11/1938 Levy ..... D2/811
D123,558 S * 11/1940 Seymour ..... D2/842
D141,659 S * 6/1945 Carpenter ..... D2/602
2,568,826 A * 9/1951 Roussos ..... A41D 1/22 2/244
4,404,688 A 9/1983 Knight
2008/0148466 A1* 6/2008 Wohl ..... A42B 1/0182 2/209.3
2009/0235426 A1* 9/2009 Johnston ..... A41D 3/005 2/139
2011/0307992 A1 12/2011 Martinson
2014/0115763 A1* 5/2014 Orozco ..... A41B 13/10 2/455
2017/0273372 A1* 9/2017 Deng ..... A41D 13/1236
2022/0287398 A1* 9/2022 McDowell ..... A41B 3/12

OTHER PUBLICATIONS

J. Crew, "Tie-neck Turtleneck Sweater", archived product page with customer reviews dating back to at least Dec. 24, 2020; https://www.jcrew.com/p/womens/categories/clothing/sweaters/pullover/tieneck-turtleneck-sweater/AT983 (Year: 2020).*

* cited by examiner

*Primary Examiner* — Jocelyn Bravo
(74) *Attorney, Agent, or Firm* — The Webb Law Firm

(57) ABSTRACT

A garment, which may be a turtleneck sweater, shirt, blouse, top, dress, or other similar garment, with an adjustable collar. The adjustable collar is an open collar having first and second panel sections attached, respectively, to the two ends of the open collar. The free end of said first panel section may be removably secured to a free end of said second panel section in varying styles to allow for a range of aesthetics and comfort levels, such as in a bowtie closure or knot closure.

10 Claims, 9 Drawing Sheets

ADJUSTABLE TURTLENECK

CROSS-REFERENCE TO RELATED APPLICATION

This application claims the benefit of U.S. Provisional Patent Application No. 63/404,697, filed Sep. 8, 2022, the disclosure of which is hereby incorporated by reference in its entirety.

BACKGROUND OF THE INVENTION

Field of the Invention

The invention relates to garments, and more particularly, to turtleneck sweaters.

Discussion of the Related Art

A traditional turtleneck collar is an object of comfort and fashion. Typically, a turtleneck collar is a closed circular panel made of the same material as the shirt or sweater to which it is attached. Often, the turtleneck collar is made from a soft or stretchy material that works to keep the wearer warm while also stretching to fit the wearer's neck. However, the collar cannot be adjusted beyond any inherent stretching capacity of the material from which the collar is made, and the wearer cannot adjust the aesthetic design of the collar.

Convertible garments are a class of clothing that allow a wearer to adjust the positions and design of the clothing item according to the wearer's preferences. For example, U.S. Pat. No. 4,404,688 relates to a combination scarf provided with panel sections that can be adjusted by the wearer into various positions to create the appearance of various forms of draping. As another example, United States Patent Application Publication No. 2011/0307992 relates to a convertible dress provided with panel sections that can be adjusted into various positions to create different necklines and sleeve combinations.

SUMMARY OF THE INVENTION

It is an object of the present invention to provide an adjustable garment which can be modified by the wearer into various configurations based on the wearer's preference with regard to function, comfort, and aesthetic. The present invention is an adjustable garment having an open collar with two ends, and having first and second panel sections attached, respectively, to the two ends of the open collar. The open collar may be made from the same material as the rest of the garment, or it may be made from a different material than the rest of the garment. More particularly, the adjustable garment may be a sweater, a dress, a sleeveless shirt, and/or the like, having an open turtleneck collar with two ends and first and second panel sections attached, respectively, to the two ends of the open collar. The first and second panel sections, respectively, may be attached permanently to the two ends of the open collar, or they may be removably attached to the two ends of the open collar in various ways, such as by button, snap, hook-and-loop enclosure, and the like. The first and second panel sections may be made from a fabric or fabric-like material, such as ribbon, and may be constructed in various lengths, such as lengths longer than the length of the garment, lengths less than the length of the garment, and lengths less than half the length of the garment. A free end of the first panel section may be removably secured to a free end of the second panel section in various ways, such as by bowtie, knot, button, snap, hook-and-loop enclosure, and the like, to close the collar at different diameters, allowing the wearer to feel more comfortable depending on their preferences. Further, the panel sections may be secured together to accommodate different aesthetic choices, such as achieving the look of a loose or slouchy collar or the look of a tight or close-fit collar, or creating different tying or draping effects, such as a bowtie closure or knot closure. The open collar may be open at different positions along the neck of a wearer and, thus, the panel sections may be secured together at different positions along the neck of the wearer, such as at the back, side, or front of the neck. For example, the adjustable garment may have a free end of the first panel section removably secured via a bowtie or knot closure to a free end of the second panel section at the back, side, or front of the wearer's neck. The first and second panel sections may also be made from a different material than the material of the collar and/or the sweater to which they are attached, allowing for a greater number of aesthetic designs while still maintaining the visual effect of a traditional turtleneck collar.

DETAILED DESCRIPTION OF THE INVENTION

Figure 1:
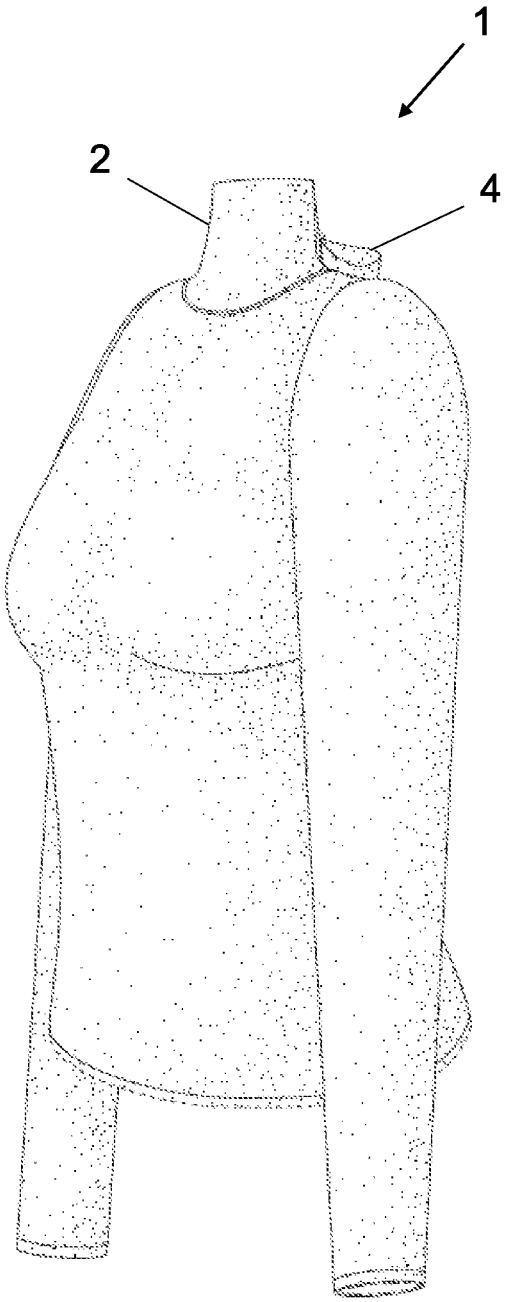
FIG. 1 is an angled front view of a non-limiting embodiment of the present invention, in which the adjustable turtleneck collar is an open collar having first and second panel sections attached, respectively, to the two ends of the open collar.

In the following detailed description, a number of details and examples are set forth to provide a thorough understanding of the present invention. These examples are not intended to represent the only way or the only embodiment in which the present invention may be practiced. It is apparent to one of ordinary skill in the art that the present invention may be practiced without these details. References to "non-limiting embodiment" or "aspect" indicate the embodiment so described may include particular features or characteristics, but not every embodiment necessarily includes the particular features or characteristics being discussed. Further, some embodiments may have some, all, or none of the features described for other embodiments.

As used in the following detailed description, "first" and "second" describe a common object and indicate that different instances of like objects are being referred to. Such adjectives are not intended to imply the objects so described must be provided in a particular sequence, either temporally, spatially, in ranking, or in any other manner. Spatial or directional terms, for example, "left", "right," "inner", "outer", "above", "below", "upper", "lower", "vertical", "horizontal", "top", "bottom", relate to the disclosure as shown in the figures and are not to be considered limiting, as the disclosure can assume various alternative orientations.

FIGS. 1-7 are various views of a non-limiting embodiment of the present invention, a garment 1 for which the collar can be configured into various styles. In the presently described embodiment, garment 1 is a sweater having an adjustable turtleneck collar 2 made from the same fabric material as the rest of the sweater. In some non-limiting embodiments, garment 1 may be a dress, a shirt, a top, or other similar style, and may or may not include sleeves. Adjustable turtleneck collar 2 is an open collar, having two open ends 3 located at the back of the adjustable turtleneck collar 2, such that open ends 3 fall at the back of a neck of a person wearing the garment 1. In other non-limiting embodiments, adjustable turtleneck collar 2 may be made from a different material as the rest of garment 1. In other non-limiting embodiments, open ends 3 may be located at another position in adjustable turtleneck collar 2, e.g. at the front or side of adjustable turtleneck collar 2, such that open ends 3 fall at the front or side of garment 1.

Adjustable turtleneck collar 2 further has first and second panel sections 4 attached, respectively, to the two open ends 3, with a free end of said first panel section being configured to be removably secured to a free end of said second panel section. For example, the first and second panel sections 4 may be secured together via tying, snaps, buttons, or a hook-and-loop enclosure. In some non-limiting embodiments, the first and second panel sections 4 are permanently attached, respectively, to the two open ends 3. In other non-limiting embodiments, the first and second panel sections 4 may be removably attached to the two open ends 3. For example, the first and second panel sections 4 may be secured to open ends 3 via tying, snaps, button, or a hook-and-loop enclosure. In some non-limiting embodiments, the first and second panel sections 4 may be made from a pliable fabric or fabric-like material, for example, ribbon, cotton, jersey, wool, and the like. In some non-limiting embodiments, the first and second panel sections 4 may be made from the same material as the rest of garment 1. In other non-limiting embodiments, the first and second panel sections 4 may be made from a different material than the rest of garment 1. In some non-limiting embodiments, the first and second panel sections 4 may span various lengths. For example, the first and second panel sections 4 may have a length greater than the length of garment 1, as measured from neck to hem, may have a length less than the length of garment 1, or may have a length less than half the length of garment 1. In the presently-described embodiment, the first and second panel sections 4 are permanently attached to open ends 3, the first and second panel sections 4 are made from a ribbon material in a length which is less than the length of garment 1, and a free end of the first panel section is removably secured to a free end of the second panel section in a bowtie style such that adjustable turtleneck collar 2 is in a closed configuration.

Figure 2:
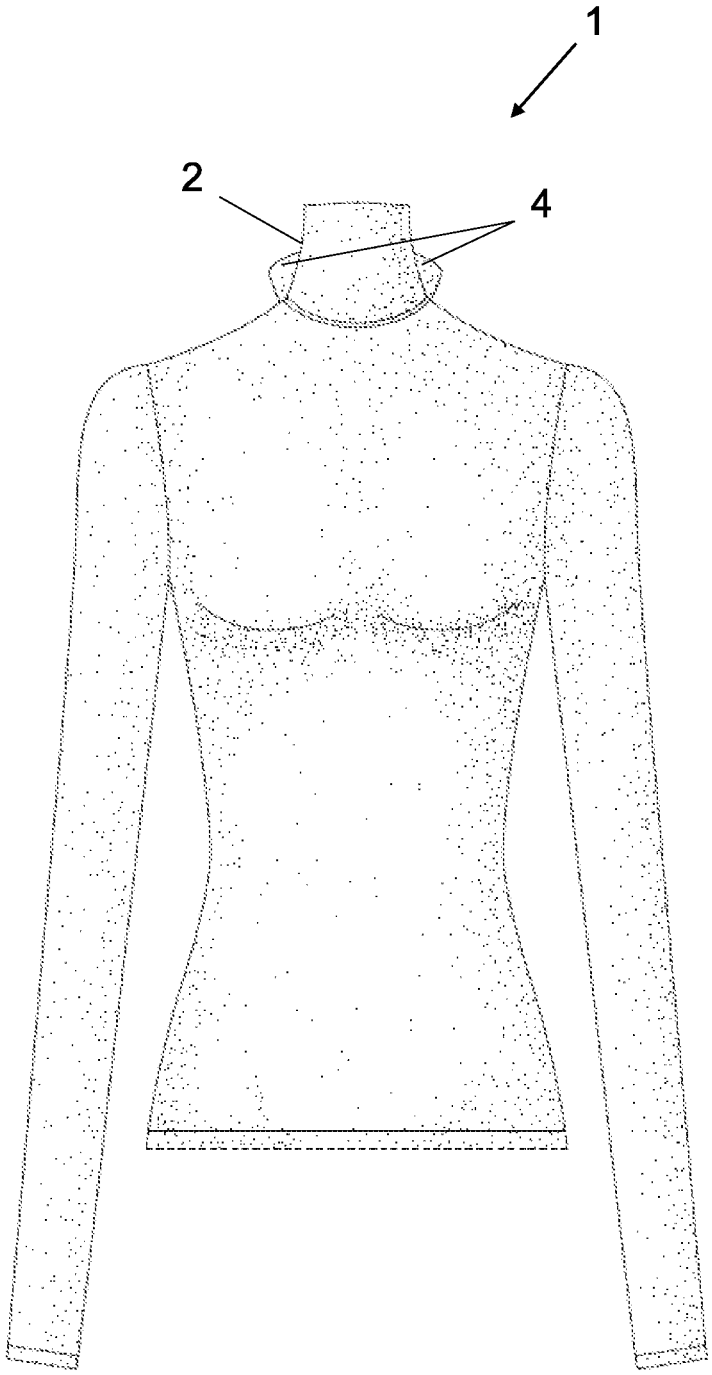
FIG. 2 is a front view of the non-limiting embodiment shown in FIG. 1.

FIG. 1 is an angled front view of the presently-described embodiment, in which garment 1 is a sweater made of a fabric material, and in which the first and second panel sections 4 are removably secured together in a bowtie style. From this perspective, garment 1 appears to be a traditional turtleneck sweater, with the bowtie only partially visible. FIG. 2 is a front view of the presently-described embodiment, in which the bowtie is only partially visible. Thus, when the wearer dons garment 1, those viewing the wearer from the front may assume garment 1 is a traditional turtleneck sweater.

Figure 3:
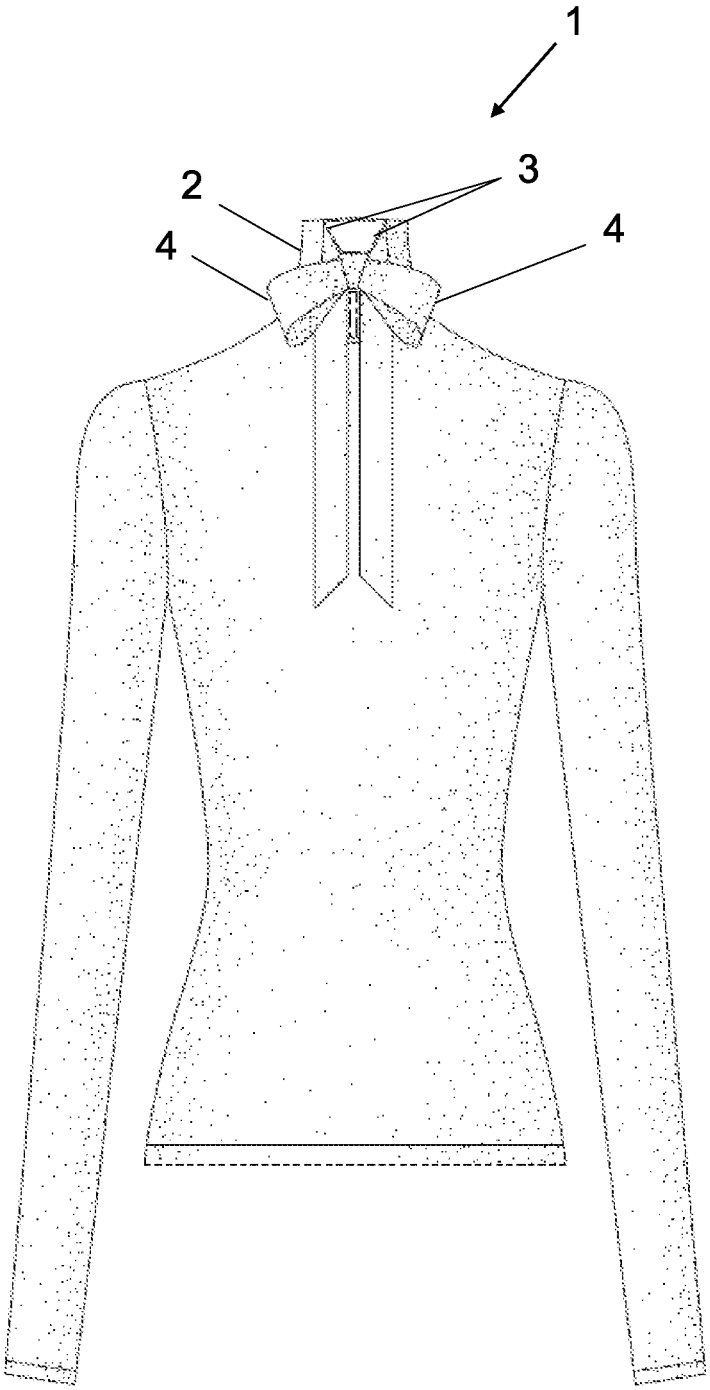
FIG. 3 is a back view of the non-limiting embodiment shown in FIG. 1.

FIG. 3 is a back view of the presently-described embodiment, in which garment 1 is a sweater made of a fabric material, and in which the first and second panel sections 4 are removably secured together in a bowtie style. From this perspective, the bowtie is fully visible, as is the adjustable nature of the adjustable turtleneck collar 2. Thus, when the wearer dons garment 1, those viewing the wearer from the back will note the unique presentation and understand that garment 1 is a nontraditional turtleneck sweater.

Figure 4:
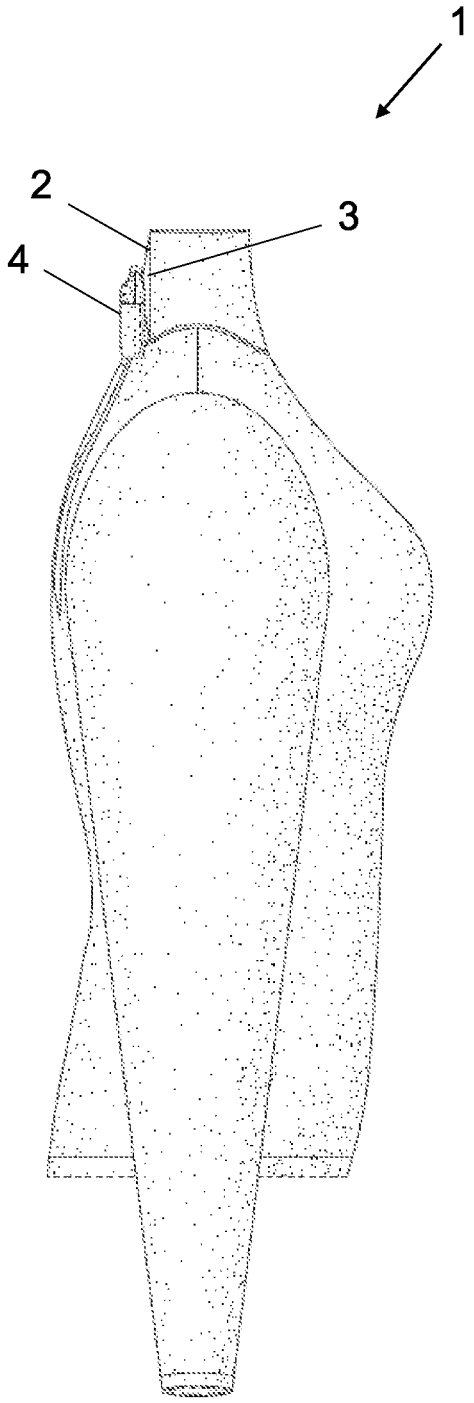
FIG. 4 is a side view of the non-limiting embodiment shown in FIG. 1.
Figure 5:
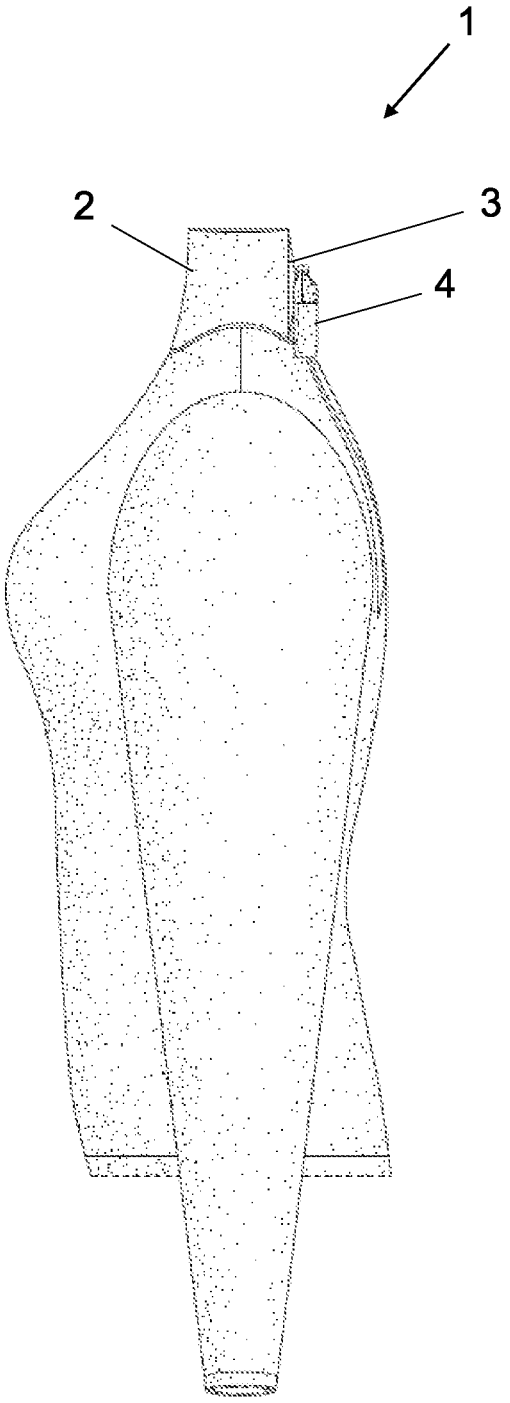
FIG. 5 is another side view of the non-limiting embodiment shown in FIG. 1.

FIGS. 4 and 5 are side views of the presently-described embodiment, in which garment 1 is a sweater made of a fabric material. FIGS. 4 and 5 further demonstrate the first and second panel sections 4 removably attached together in a bowtie style, allowing the bowtie to sit at the back of the neck of a person wearing garment 1. The bowtie style may be tied at different lengths of the first and second panel sections 4, for example, to accommodate varying comfort levels of persons wearing garment 1.

Figure 6:
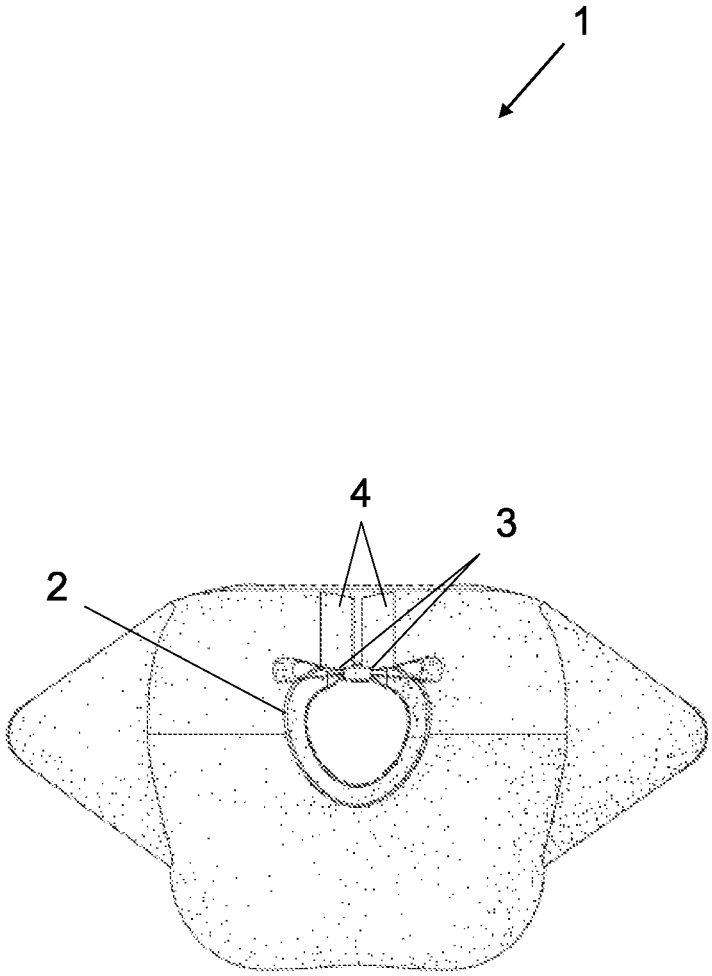
FIG. 6 is an aerial view of the non-limiting embodiment shown in FIG. 1.
Figure 7:
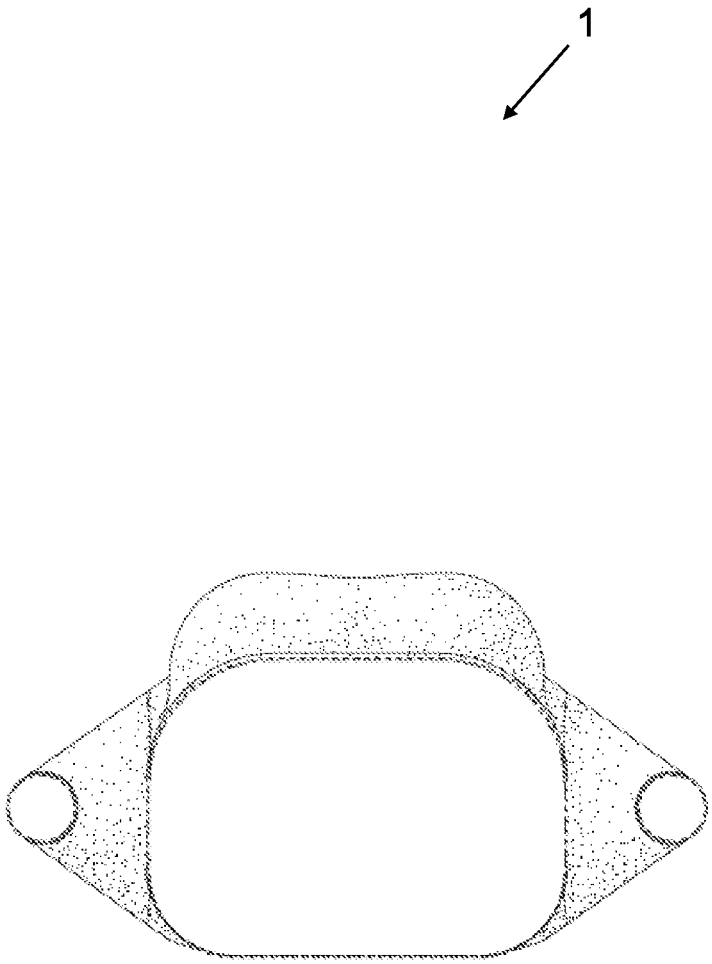
FIG. 7 is a bottom view of the non-limiting embodiment shown in FIG. 1.
Figure 8:
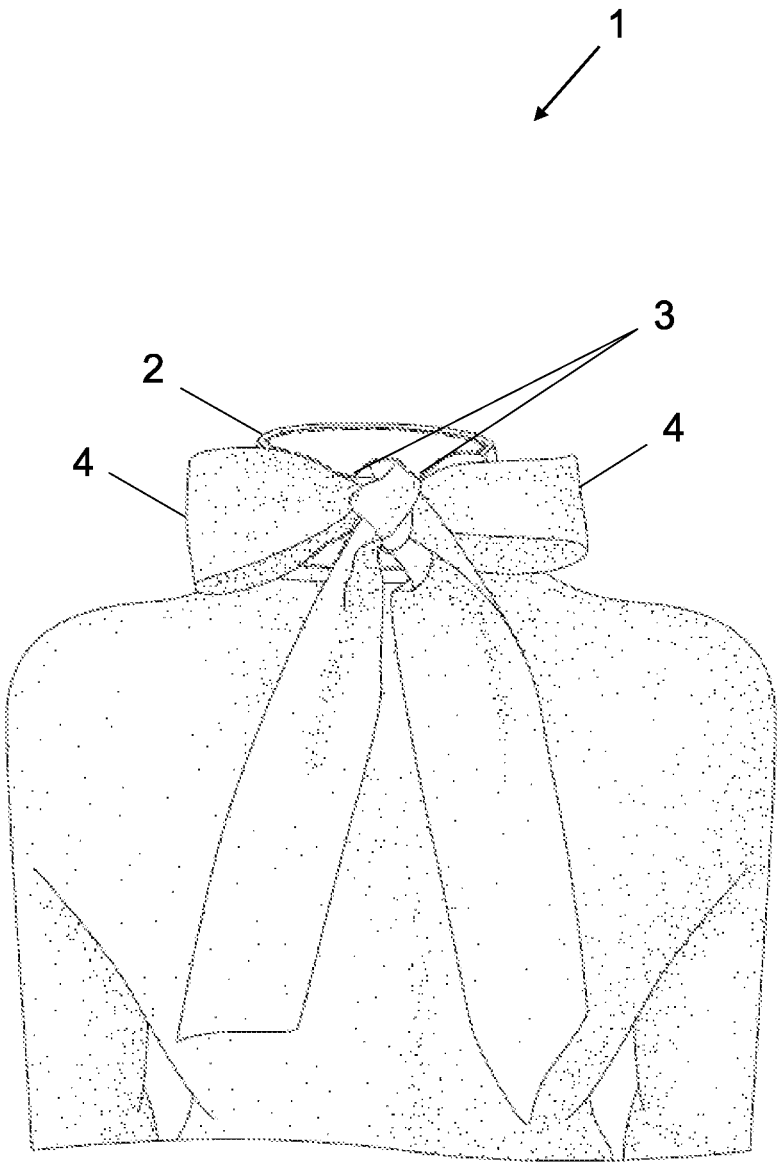
FIG. 8 is an enlarged back view of the non-limiting embodiment shown in FIG. 1.

FIGS. 6 and 7 demonstrate aerial and bottom views of the presently-described embodiment. FIG. 8 is an enlarged back view of the presently-described embodiment, demonstrating that the adjustable turtleneck collar has two open ends attached only by the first and second panels tied together into a bow configuration.

Figure 9:
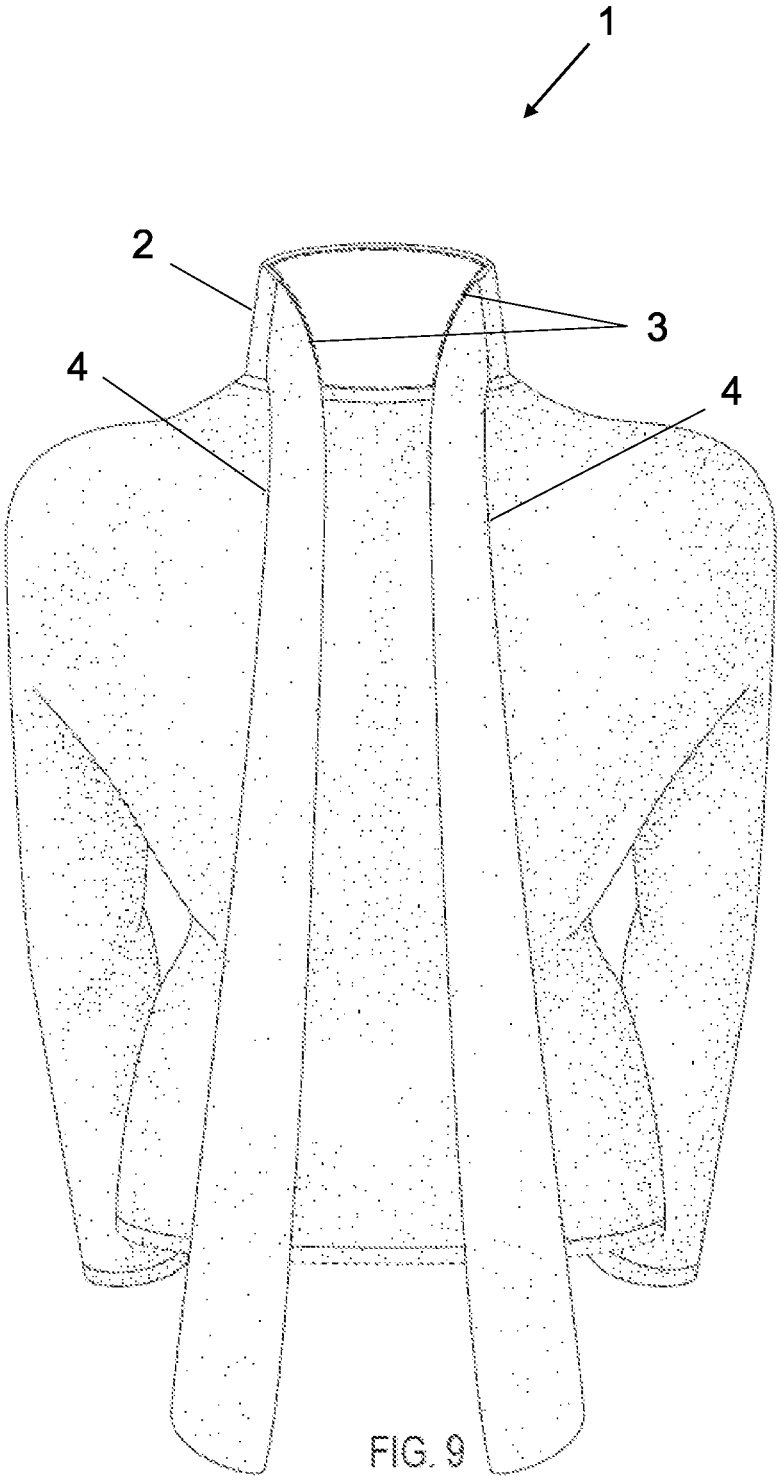
FIG. 9 is a back view of a different configuration of the non-limiting embodiment shown in FIG. 1.

FIG. 9 is a view of a different configuration of the non-limiting embodiment from what was shown in FIGS. 1-8. As shown in FIG. 9, adjustable turtleneck collar 2 is in an open or loose configuration. No panel section of the first and second panel sections 4 is attached to another panel section. Instead, the first and second panel sections 4 hang loosely down the back of garment 1. In other embodiments, the first panel sections may be removably attached to the second panel section in varying styles, such as a single knot which allows the first and second panel sections 4 to drape down the back while keeping the collar 2 in a closed configuration, or other styles of removable attachment or non-attachment.

In some non-limiting embodiments, garment 1 may be a dress made of a fabric or fabric-like material, which may or may not include sleeves, and which may or may not be made of the same materials as adjustable turtleneck collar 2.

The present invention has been described with respect to certain embodiments. However, it will be appreciated by persons skilled in the art that a number of other configurations and styles may be further created or modified from the present invention.

The invention claimed is:

1. An adjustable garment, comprising:

a sweater body portion;

an open turtleneck collar comprising two ends; and first and second panel sections attached, respectively, to the two ends of the open turtleneck collar, wherein the open turtleneck collar defines an opening at a back side of the garment configured to be located at a back side of a neck of a wearer, wherein the first panel section defines a free end and the second panel section defines a free end, wherein the free end of said first panel section is configured to be removably secured to the free end of said second panel section at the back side of the garment, wherein the open turtleneck collar and the sweater body portion are made from a same material, wherein the same material is knitted, wherein the first and second panel sections are made from a different material from which the collar and the sweater body portion are made, wherein the different material is a woven ribbon material, and wherein the first and second panel sections are permanently attached to the two ends of the open collar.

2. The adjustable garment of claim 1, wherein the garment is a dress.

3. The adjustable garment of claim 1, wherein the garment is a top.

4. The adjustable garment of claim 1, wherein the first and second panel sections comprise a length longer than a length of the adjustable garment.

5. The adjustable garment of claim 1, wherein the first and second panel sections comprise a length less than a length of the adjustable garment.

6. The adjustable garment of claim 1, wherein the first and second panel sections comprise a length less than half a length of the adjustable garment.

7. The adjustable garment of claim 1, wherein the first and second panel sections are removably secured in a bowtie closure.

8. The adjustable garment of claim 1, wherein the first and second panel sections are removably secured in a knot closure.

9. The adjustable garment of claim 1, wherein the garment is sleeveless.

10. The adjustable garment of claim 1, wherein the open collar is configured to extend high up the wearer's neck to sit right under the wearer's chin.

* * * * *